US010281249B2

(12) United States Patent
Montaño Rueda et al.

(10) Patent No.: US 10,281,249 B2
(45) Date of Patent: May 7, 2019

(54) PROTECTION CIRCUIT IN BLASTING SYSTEMS

(71) Applicant: MaxamCorp Holding, S.L., Madrid (ES)

(72) Inventors: Luis Diego Montaño Rueda, Galdácano-Vizcaya (ES); Jose Maria Ayensa Muro, Galdácano-Vizcaya (ES)

(73) Assignee: MaxamCorp Holding, S.L., Madrid (ES)

( * ) Notice: Subject to any disclaimer, the term of this patent is extended or adjusted under 35 U.S.C. 154(b) by 0 days.

(21) Appl. No.: 15/562,827

(22) PCT Filed: Mar. 30, 2016

(86) PCT No.: PCT/EP2016/056917

§ 371 (c)(1),
(2) Date: Sep. 28, 2017

(87) PCT Pub. No.: WO2016/156395

PCT Pub. Date: Oct. 6, 2016

(65) Prior Publication Data

US 2018/0106578 A1 Apr. 19, 2018

(30) Foreign Application Priority Data

Mar. 30, 2015 (EP) ..... 15382158

(51) Int. Cl.
*F42B 3/182* (2006.01)
*F42B 3/12* (2006.01)
(Continued)

(52) U.S. Cl.
CPC ..... *F42B 3/182* (2013.01); *F42B 3/122* (2013.01); *F42B 3/16* (2013.01); *F42C 11/06* (2013.01); *F42D 1/055* (2013.01)

(58) Field of Classification Search
None
See application file for complete search history.

(56) References Cited

U.S. PATENT DOCUMENTS 5,173,569 A 12/1992 Pallanck et al.
5,929,368 A * 7/1999 Ewick ..... F42B 3/121 102/210

(Continued)

FOREIGN PATENT DOCUMENTS

DE 3533389 6/1986
WO WO-2016156395 10/2016

OTHER PUBLICATIONS

"European Application No. 15382158.2, Extended European Search Report dated Sep. 15, 2015", (Sep. 15, 2015), 7 pgs.

(Continued)

*Primary Examiner* — Dimary S Lopez Cruz
(74) *Attorney, Agent, or Firm* — Schwegman Lundberg & Woessner, P.A.

(57) ABSTRACT

There is provided an electronic detonator with electronic delayer, comprising: —a conductive shell comprising —an open end for receiving elements such as an explosive charge, and —a closed end, and —a printed circuit board (PCB) comprising the electronic circuit of the delayer, the printed circuit board being placed inside the conductive shell, characterized in that the electronic detonator further comprises at least a resilient, compressible and conductive gasket —positioned by the open end in a space defined by the PCB and an inner surface of the conductive shell, —filling at least part of the space between the PCB and the inner surface of the conductive shell, such that protection against electromagnetic interferences (EMI) is allowed and —contacting the ground connection of the PCB and the inner surface of the conductive shell such that acts as connection path for (Continued)

grounding the PCB, allowing protection against electrostatic interference (ESD).

12 Claims, 4 Drawing Sheets

(51) Int. Cl.

| | |
|---|---|
| ***F42B 3/16*** | (2006.01) |
| ***F42C 11/06*** | (2006.01) |
| ***F42D 1/055*** | (2006.01) |

(56) References Cited

U.S. PATENT DOCUMENTS

| | | | | |
|---|---|---|---|---|
| 7,617,775 | B2 * | 11/2009 | Teowee ..... | F42B 3/122<br>102/206 |
| 2004/0007834 | A1 | 1/2004 | Kohler et al. | |
| 2005/0011390 | A1 | 1/2005 | Jennings, III | |

OTHER PUBLICATIONS

"International Application No. PCT/EP2016/056917, International Search Report and Written Opinion dated Dec. 9, 2016", (Dec. 9, 2016), 8 pgs.

* cited by examiner

PROTECTION CIRCUIT IN BLASTING SYSTEMS

PRIORITY CLAIM TO RELATED APPLICATIONS

This application is a U.S. national stage application filed under 35 U.S.C. § 371 from International Application Serial No. PCT/EP2016/056917, which was filed 30 Mar. 2016, and published as WO2016/156395 on 6 Oct. 2016, and which claims priority to European Application No. 15382158.2, filed 30 Mar. 2015, which applications and publication are incorporated by reference as if reproduced herein and made a part hereof in their entirety, and the benefit of priority of each of which is claimed herein.

TECHNICAL FIELD OF THE INVENTION

The present disclosure relates generally to electronic blasting systems, and particularly to protection devices against electromagnetic interference and electrostatic discharge.

BACKGROUND OF THE INVENTION

Detonator and blasting systems have applications in the mining, quarry, construction, pipeline and geophysical exploration industries, where a multitude of detonators may be connected.

Electronic delay elements are provided in electronic detonators, in the inner part of a metallic round shell which is a piece holding an explosive charge; a printed circuit board (PCB) comprising the electronic components of the delayer is provided with an electric contact to said shell for electrostatic discharge (ESD) protection. The electric contact is usually provided by having metallic terminals from the PCB to the shell; however the use of metallic parts or terminals presents do not have proper protection against electromagnetic interference (EMI) because they do not provide a proper sealing at the open end in the inlet of the shell.

The current solutions used in the industry are made by hand soldered wire pieces and cannot be automated by surface mount technology (SMD) or any other automated process and as mentioned before do not protect against EMI.

Electronic devices are exposed to electromagnetic interferences so there is a need for a detonator which provides protection against EMI and ESD at the same time.

STATEMENT OF THE INVENTION

The present invention provides a solution for the aforementioned problem by an electronic detonator according to claim 1, a blasting system according to claim 9, method for enabling or disabling a blasting system according to claim 10, and a method for manufacturing an electronic detonator according to claim 11. Dependent claims define particular embodiments of the invention. All the features described in this specification (including the claims, description and drawings) and/or all the steps of the described method can be combined in any combination, with the exception of combinations of such mutually exclusive features and/or steps.

In a first aspect of the invention there is provided an electronic detonator with electronic delayer, comprising:

- a conductive shell comprising
  - an open end or inlet for receiving elements such as an explosive charge, and
  - a closed end,
- and
- a printed circuit board (PCB) comprising the electronic circuit of the delayer, the printed circuit board being placed inside the conductive shell,
- characterized in that the electronic detonator further comprises at least a resilient, compressible and conductive gasket
  - positioned by the open end in a space defined by the PCB and an inner surface of the conductive shell,
  - filling at least part of the space between the PCB and the inner surface of the conductive shell, such that protection against electromagnetic interferences (EMI) is allowed and
  - contacting a ground connection of the PCB and the inner surface of the conductive shell such that the contact acts as connection path for grounding the PCB, allowing protection against electro-static interference (ESD).

Advantageously, an electronic delayer comprising a resilient, compressible and conductive gasket provides protection against electromagnetic interference EMI. Besides, contacting a ground connection of the PCB and the inner surface of the conductive shell provides for protection against ESD.

The resilient, compressible and conductive gasket establishes a low resistance contact to the shell, and on the other hand seals the opened space in the inlet of the shell for EMI protection.

The use of the gasket allows the automatic assembly of the circuits instead of soldering wires by hand. This solution is cheaper and its production is faster by reducing the manual labor, in particular in SMD processes.

Advantageously the immunity of the electronic detonators against EMI and ESD applied to the circuit and/or the lead wires is enhanced, by using flexible gaskets connected to the circuit by any means e.g. surface mount technology.

In an embodiment of the invention the conductive shell is made of metal, preferably copper or aluminium. Advantageously a metallic shell acts like an electrically conductive shield.

In an embodiment of the invention the gasket is adapted to cover the complete opening between the PCB and the detonator shell. Advantageously this embodiment provides with full isolation of one side of at least a partial length of the PCB from any EMI external to the detonator.

In an embodiment of the invention the detonator comprises two conductive gaskets. Advantageously, positioning first gasket on one side of the PCB and second gasket on the opposite side provides with full isolation on both sides of at least a partial length of the PCB from any external EMI.

In an embodiment of the invention the gasket is positioned on a shield connection point of the PCB. The shield connection point of the PCB is the ground pin of the PCB. Advantageously this positioning provides proper grounding to the PCB and the detonator so that ESD is completely avoided.

In an embodiment of the invention the gasket is made of a low resistance material. Advantageously an electronic delayer comprising an elastic and compressible gasket for protection against EMI combined with a low DC resistance for circuit grounding to an external conductive surface provides an improved solution against ESD.

In an embodiment of the invention the gasket is positioned on a plane coinciding with the plane of the edge of the open end of the conductive shell. Advantageously, the gasket positioned on the edge allows the complete length of the PCB to be protected against any external EMI.

In an embodiment of the invention the gasket comprises an inner hole by which the gasket is connected to the shield connection point of the PCB, preferably by means of melted tin. Advantageously the position of the gasket on the PCB is securely fastened by an inner hole in the gasket.

In an embodiment of the invention the gasket is semi-circle shaped. Advantageously if a rounded shell is provided, a semi-circled shape of the gasket provides complete adaptation to the open space between the inner part of the shell and the PCB.

In a second aspect of the invention there is provided a blasting system comprising an electronic detonator with electronic delayer according to the first aspect of the invention.

In a third aspect of the invention there is provided a method for manufacturing an electronic detonator according to the first aspect of the invention comprising assembling at least one resilient, compressible and conductive gasket in a position such that the gasket is

- positioned by the open end in a space defined by the PCB and an inner surface of the conductive shell,
- filling at least part of the space between the PCB and the inner surface of the conductive shell, such that protection against electromagnetic interferences (EMI) is allowed and
- contacting the ground connection of the PCB and the inner surface of the conductive shell such that it acts as connection path for grounding the PCB, allowing protection against electro-static interference (ESD).

In an embodiment of the third aspect of the invention the gasket is positioned on a shield connection point of the PCB.

DESCRIPTION OF THE DRAWINGS

These and other characteristics and advantages of the invention will become clearly understood in view of the detailed description of the invention which becomes apparent from preferred embodiments of the invention, given just as an example and not being limited thereto, with reference to the drawings.

DETAILED DESCRIPTION OF THE INVENTION

Once the object of the invention has been outlined, specific non-limitative embodiments are described hereinafter.

Figure 1A:
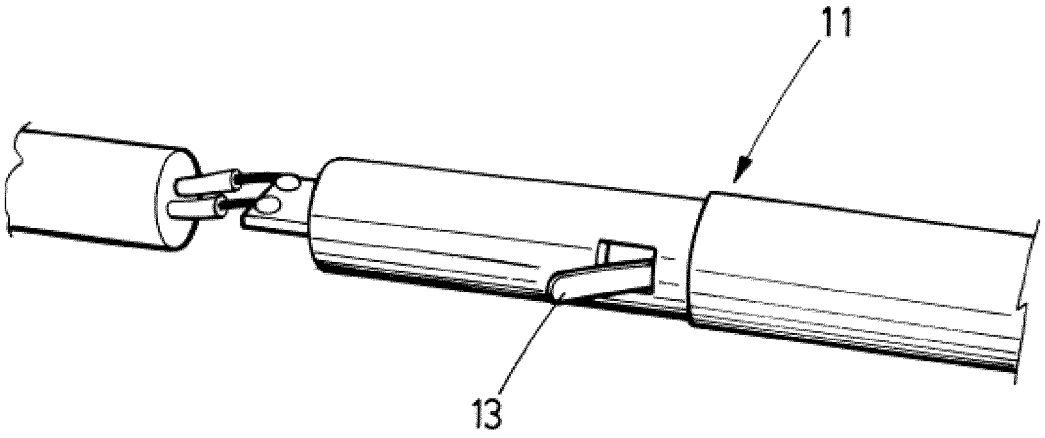
FIG. 1A This figure represents a detonator (11) according to the state of the art.
Figure 1B:
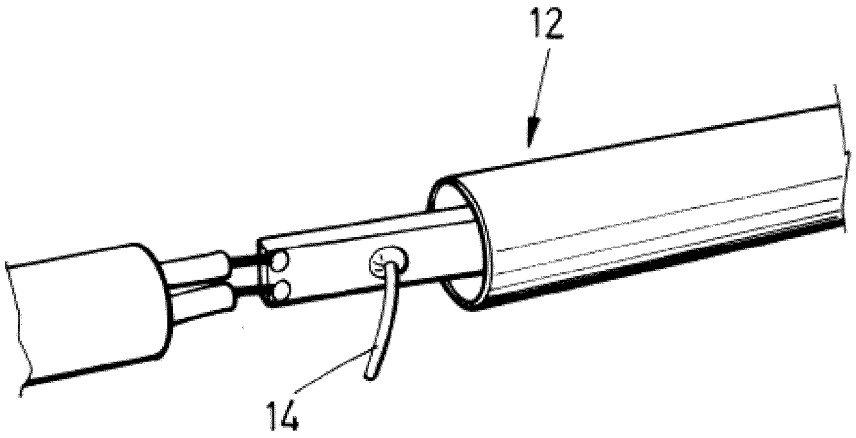
FIG. 1B This figure represents a detonator (13) according to the state of the art.

FIGS. 1A and 1B represent detonators (11, 13) according to the state of the art for which hand soldered wire pieces (12, 14) are used and which cannot be included in an automatic SMT process; they do not protect against EMI.

Said solutions in the state of the art use normally 2 ways of protection, the first is to solder a piece of metal from the PCB to the shell, and the other solution is to have copper pads in the edge of the PCB to ease the spark between the shell and the pad in case of electrostatic discharge. None of these solutions provides with EMI protection in the way the invention does; besides, solutions in the state of the art require manual assembly process.

Figure 2:
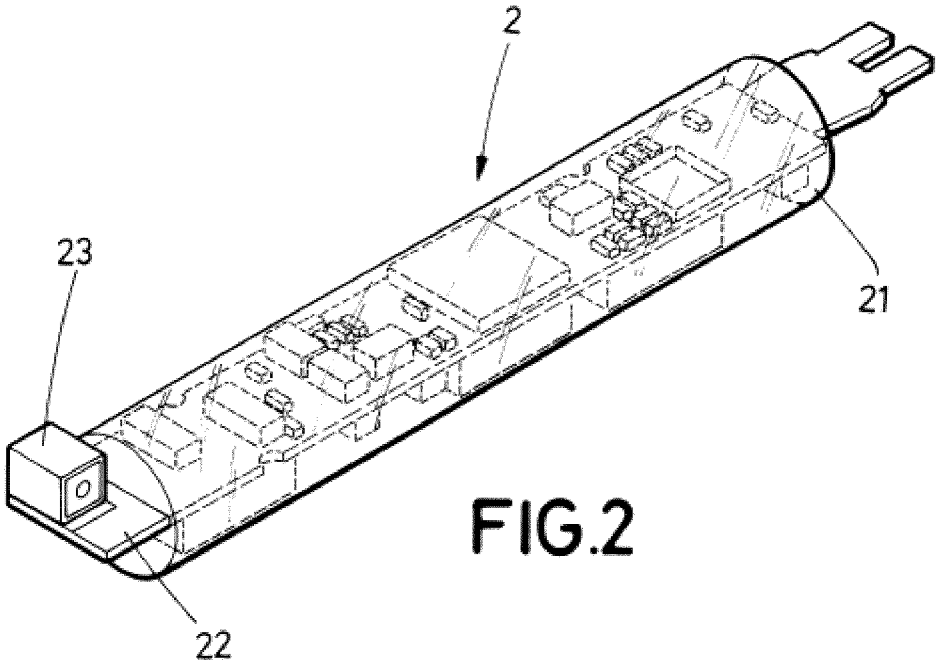
FIG. 2 This figure represents a solution according to the present invention wherein a detonator (2) is represented.

FIG. 2 shows a solution according to the present invention wherein a detonator (2) is represented. The detonator (2) comprises a shell (21) having the electronic circuit for a delayer in the PCB (22) and a resilient, compressible and conductive gasket (23) which is represented before being inserted into the shell (21).

The PCB (22) grounded to the outer part of the shell (23) provides protection against ESD via a physical connection. ESD protection is therefore provided against voltage transients and other transient events.

Figure 3:
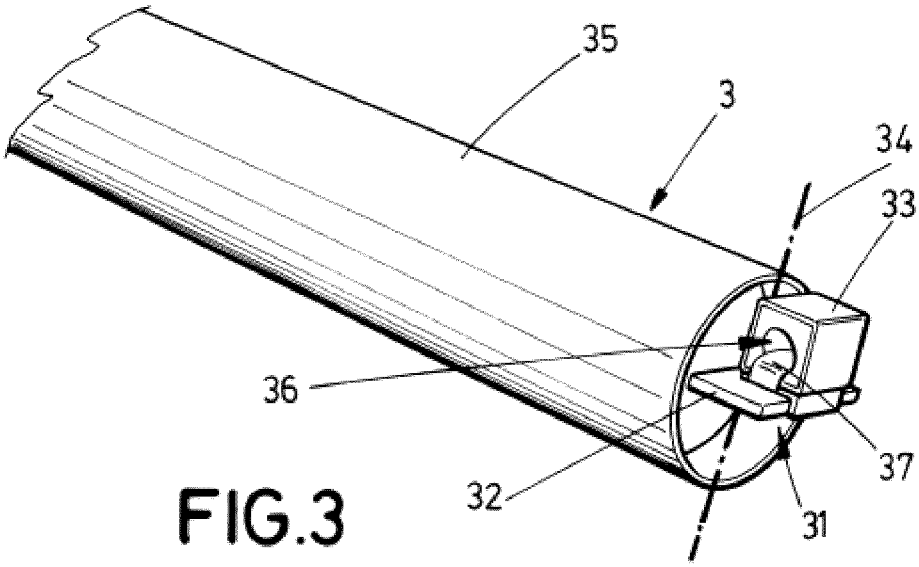
FIG. 3 This figure represents a detonator (3) according to the invention. A shield connection point (31) may be the specific part of the PCB (32) where a compressive conductive gasket (33) is positioned establishing a connection to the ground of the PCB.

FIG. 3 shows a detonator (3) according to the invention. A shield connection point (31) may be the specific part of the PCB (32) where a compressive conductive gasket (33) is positioned establishing a connection to the ground of the PCB. In the state of the art a piece of wire is used for achieving ESD protection but said solution requires manual soldering, whereas the solution according to the invention advantageously uses an automated surface mount process. In this embodiment the gasket (33) is positioned on a shield connection point of the PCB. Advantageously this positioning provides proper grounding to the PCB and the detonator so that the circuit is completely protected against ESD.

Besides, the gasket (33) is positioned on a plane (34) coinciding with the plane of the edge of the open end of the conductive shell (35). Advantageously, the gasket (33) positioned on (34) the edge allows the complete length of the PCB (32), from the open end until the closed end where the explosive may be inserted, to be protected against any external EMI.

There is also shown an inner hole (36) by which the gasket (33) is connected to the shield connection point (31) of the PCB (32), preferably by means of melted tin (37). Advantageously the position of the gasket (33) on the PCB (32) is securely fastened by said inner hole (37) in the gasket.

Figure 4:
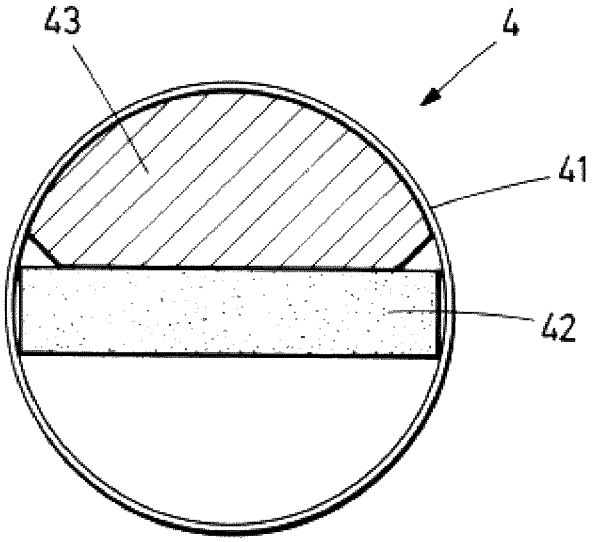
FIG. 4 This figure represents a front view of the detonator (4) comprising a shell (41), a PCB (42) and a gasket (43) which has been inserted between the shell (41) and the PCB (42).

FIG. 4 shows a front view of the detonator (4) comprising a shell (41), a PCB (42) and a gasket (43) which has been inserted between the shell (41) and the PCB (42). In this embodiment the gasket presents a shape different from a semi-circle and therefore the space between the inner part of the shell (41) and the PCB (42) is not completely covered, giving however a good EMI protection.

Figure 5:
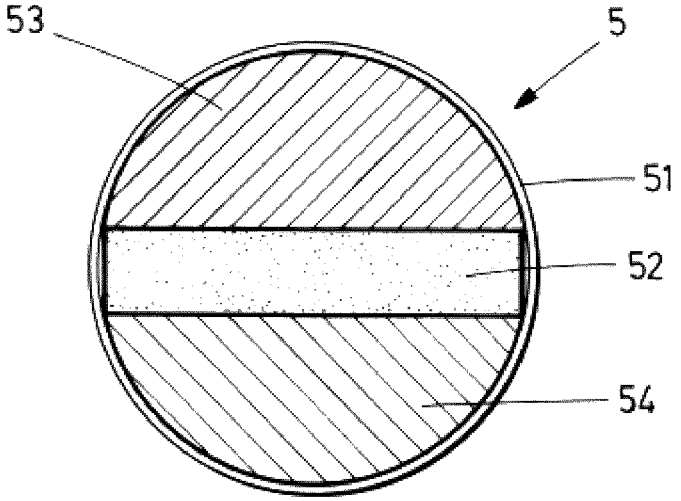
FIG. 5 This figure represents a front view of the detonator (5) comprising a shell (51), a PCB (52) and two gaskets (53, 54) which have been inserted between the shell (51) and the PCB covering the whole area between them.

FIG. 5 shows a front view of the detonator (5) comprising a shell (51), a PCB (52) and a gasket (53) which has been inserted between the shell (51) and the PCB (52). In this embodiment the gasket (53, 54) presents a semi-circle shape and therefore the space between the inner part of the shell (51) and the PCB (52) is completely covered. Besides in the embodiment of FIG. 5 there are represented two gaskets (53, 54), achieving an optimal protection against EMI.

In an embodiment, the gasket is a highly compressible and resilient electrically conductive pad which is compatible with standard surface mount technology (SMT) installation processes. Besides it is comprised in a conductive silver-coated hollow silicone extrusion bonded to a silver-plated metal support layer adapted to be welded. By piecing a series of parts of identical or varying lengths on a PCB ground trace, an efficient EMI seal can be formed between the PCB and corresponding shield housing. This enables users to create a low cost, custom EMI gasket at the board level without special tooling or custom installation equipment.

Manufacturing Method:

FIGS. 6A, 6B, 6C and 6D show an example of steps of an embodiment of a method for manufacturing a detonator (6) according to the invention. The PCB (61) may be inserted into a metallic shell (62); subsequently the compressive gasket (63) is positioned to fill the space between the shell (62) and the PCB (61) protecting the circuit and making contact from the circuit to the shell. The gasket is positioned on a shield connection point (67) of the PCB (61).

In FIGS. 6A, 6B, 6C and 6D the following elements are shown:

lead wires (64) for conducting a detonation signal, rubber bushing (65) for protecting the detonator (6) from external conditions like humidity and dust, gasket (63), fuse head (66) for detonating.

Figures 6A, 6B, 6C, 6D:
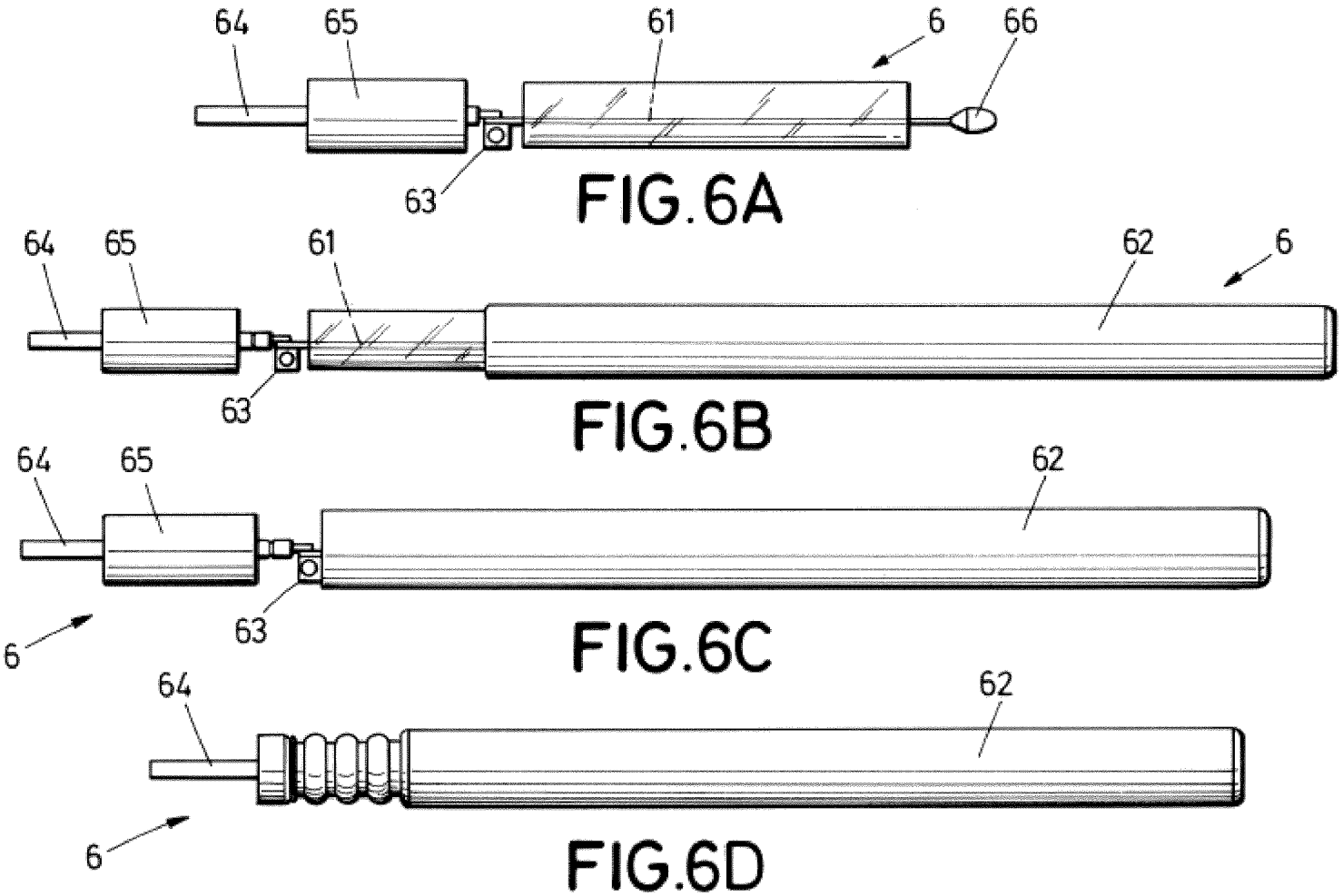
FIG. 6A This figure represents a PCB (61), lead wires (64), rubber bushing (65), gasket (63) and fuse head (66).
FIG. 6B This figure represents a metallic shell (62) in which the rest of the elements of figure A are being inserted.
FIG. 6C This figure represents a metallic shell covering the elements until the gasket (63).
FIG. 6D This figure represents complete detonator (6) covered and completely assembled.

Different positions of the different parts of the detonator (6) and the sequence of assembling them are shown:

FIG. 6A: shows the PCB (61), lead wires (64), rubber bushing (65), gasket (63), a shell (62) comprising an open end and a closed end, and fuse head (66);

FIG. 6B: shows the metallic shell (62) in which the rest of the elements of FIG. 6A are being inserted;

FIG. 6C: shows the metallic shell covering the elements until the gasket (63);

FIG. 6D: shows the complete detonator (6) covered and completely assembled.

The invention claimed is:

1. An electronic detonator with electronic delayer, comprising:

a conductive shell comprising:

an open end or inlet for receiving elements such as an explosive charge, and a closed end, and a printed circuit board (PCB) comprising the electronic circuit of the delayer, the PCB being placed inside the conductive shell, wherein the electronic detonator further comprises at least a resilient, compressible and conductive gasket in a position such that the gasket is:

positioned by the open end in a space defined by the PCB and an inner surface of the conductive shell, filling at least part of the space between the PCB and the inner surface of the conductive shell, such that protection against electromagnetic interferences (EMI) is allowed and contacting a ground connection of the PCB and the inner surface of the conductive shell such that it acts as a connection path for grounding the PCB, allowing protection against electro-static interference (ESD).

2. The electronic detonator with electronic delayer according to claim 1 wherein the conductive shell is made of metal, preferably copper or aluminium.

3. The electronic detonator with electronic delayer according to claim 1 wherein the gasket is adapted to cover a complete opening between the PCB and the conductive shell.

4. The electronic detonator with electronic delayer according to claim 1 comprising two conductive gaskets.

5. The electronic detonator with electronic delayer according to claim 1 wherein the gasket is positioned on a shield connection point of the PCB.

6. The electronic detonator with electronic delayer according to claim 1 wherein the gasket is made of a low resistance material.

7. The electronic detonator with electronic delayer according to claim 1 wherein the gasket is positioned on a plane coinciding with a plane of an edge of the open end of the conductive shell.

8. The electronic detonator with electronic delayer according to claim 1 wherein the gasket comprises an inner hole by which the gasket is connected to a shield of the PCB, preferably by means of melted tin.

9. The electronic detonator with electronic delayer according to claim 1 wherein the gasket is semi-circle shaped.

10. The method for manufacturing the electronic detonator according to claim 9 wherein the gasket is positioned on a shield connection point of the PCB.

11. A blasting system comprising an electronic detonator with electronic delayer according to claim 1.

12. A method for manufacturing the electronic detonator according to claim 1 comprising assembling the at least one resilient, compressible and conductive gasket in the position such that the gasket is:

positioned by the open end in the space defined by the PCB and the inner surface of the conductive shell, filling at least part of the space between the PCB and the inner surface of the conductive shell, such that protection against electromagnetic interferences (EMI) is allowed and contacting the ground connection of the PCB and the inner surface of the conductive shell such that it acts as the connection path for grounding the PCB, allowing protection against electro-static interference (ESD).

* * * * *